United States Patent [19]

Paton et al.

[11] 4,017,672

[45] Apr. 12, 1977

[54] PLASMA-ARC FURNACE FOR REMELTING METALS AND ALLOYS

[76] Inventors: Boris Evgenievich Paton, ulitsa Kotsjubinskgo 11/13, kv. 21; Viktor Iosifovich Lakomsky, ulitsa Anri Barbjusa, 22–26, kv. 119; Gennady Fedorovich Torkhov, Prazhskaya ulitsa 3, kv. 456; Vladimir Kirillovich Trigub, ulitsa Vernadskogo 63, kv. 61; Ivan Vasilievich Sheiko, ulitsa Schuseva, 36, kv. 32, all of, Kiev; Emil Vasilievich Verkhovtsev, ulitsa Ordzhonikidze, 28, kv. 9, Izhevsk; Sergei Panteleevich Bakumenko, ulitsa Sovetskaya, 21, kv. 17, Izhevsk; Nikolai Alexeevich Ponomarev, ulitsa Truda, 34, kv. 18, Izhevsk; Anatoly Alexandrovich Kuzmin, ulitsa Sovetskaua, 21, kv. 2, Izhevsk, all of U.S.S.R.

[22] Filed: Mar. 11, 1976

[21] Appl. No.: 665,934

[52] U.S. Cl. ..... 13/2 P; 75/10 C; 164/250

[51] Int. Cl.[2] ..... H05H 1/26

[58] Field of Search ..... 13/2, 18, 2 P, 34, 9, 13/31; 75/10 R, 10 C; 164/50, 250, 252

[56] References Cited

UNITED STATES PATENTS

| | | | |
|---|---|---|---|
| 3,524,006 | 8/1970 | Ebeling et al. | 13/34 |
| 3,723,630 | 3/1973 | Paton et al. | 13/18 X |
| 3,828,107 | 8/1974 | Sone | 13/2 P |
| 3,849,543 | 11/1974 | Zirngibl et al. | 13/18 X |

*Primary Examiner*—R. N. Envall, Jr.
*Attorney, Agent, or Firm*—Lackenbach, Lilling & Siegel

[57] ABSTRACT

A plasma-arc furnace for remelting metals and alloys comprising a chamber with openings, which accommodates therein a plasmatron including a consumable electrode with an axial through-going internal space, and a water-cooled rod of a mechanism for moving this plasmatron in a vertical direction, said electrode and said rod being operatively connected with each other, the rod extending into the chamber through one of its openings. The furnace further includes a flexible gas conduit having one of its end portions projecting outwardly through another opening in said chamber and connected to a source of plasma-yielding gas, the other end of this conduit communicating with the internal axial space of said plasmatron. The furnace also includes a water-cooled crystallizer for accumulating liquid metal therein communicating with the chamber, the water-cooled rod and the water-cooled crystallizer being connected to a power supply source.

2 Claims, 1 Drawing Figure

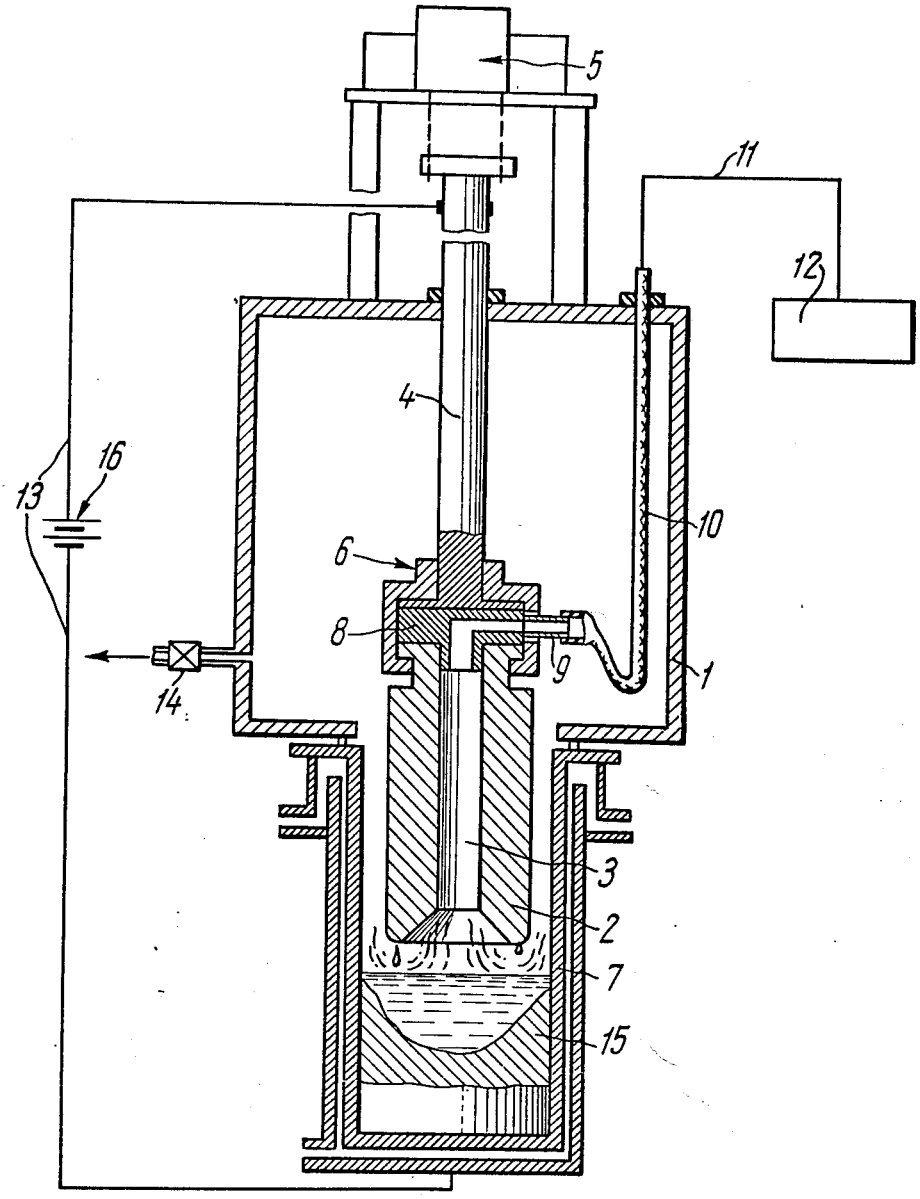
5
11
12
4
16
13
10
6
8
9
1
14
3
2
7
15

PLASMA-ARC FURNACE FOR REMELTING METALS AND ALLOYS

The invention relates to electrometallurgy and, more particularly, it relates to plasma-arc furnaces for remelting metals and their alloys.

The invention can be utilized in the process of production of extra-pure metals and high-precision alloys.

The development of modern engineering, such as aircraft and rocket engineering, the nuclear power industry, chemistry and electronics, cryogenics and other arts, has been putting ever stricter requirements than before on the metals and their alloys being used, particularly those concerning their purity and mechanical properties. However, the existing methods of making metals and their alloys more often than not fail to ensure the required level of the said properties, since they do not positively preclude contact between a metal and the atmospheric air and refractory materials. Therefore, lately there has been ever increasingly employed the secondary remelting methods with dropwise transfer of metal from a melting object into a mold, with the ingot being shaped in a water-cooled copper crystallizer.

Among these above-mentioned methods offering the finest fine perspectives is based on plasma-arc remelting for production of extra-pure metals and their alloys, since it is the only method which offers the greatest number of ways and means of controlling the liquid metal.

There are known plasma-arc furnaces for remelting metals and alloys comprising a sealed chamber, a plasmatron in the form of a consumable electrode with an internal axial through-going space, a water-cooled hollow rod of a mechanism for moving the consumable plasmatron vertically, which is also the gas conduit, and a water-cooled crystallizer.

In this known plasma-arc furnace the sealed chamber accommodates therein the plasmatron, which is in the form of the consumable electrode with an axial bore therethrough, operatively connected with the water-cooled hollow rod which serves as the gas conduit, the rod belonging to the mechanism for moving the plasmatron in a vertical direction, the water-cooled crystallizer communicating with the said sealed chamber. However, in the hitherto known furnaces of this kind the hollow rod has a complicated structure which is inconvenient in manufacture and costly.

It is an object of the present invention to simplify the structure of the rod of the plasmatron-moving mechanism.

It is another object of the present invention to provide for the reliable supply of a plasma-yielding gas into the internal space of the electrode.

It is yet another object of the present invention to render a plasma-arc furnace less costly in manufacture.

These and other objects are accomplished in a plasma-arc furnace for remelting metals and alloys, comprising a chamber with openings, which accommodates therein a plasmatron in the form of a consumable electrode having an axial internal space therethrough, a water-cooled rod of a mechanism for moving the plasmatron in the vertical direction, which extends through one of the openings into said chamber, the plasmatron and the rod being operatively connected with each other, a water-cooled crystallizer for accumulating liquid metal therein, which communicates with said chamber, the chamber being connected to a supply system of a plasma-yielding gas, the water-cooled rod and the water-cooled crystallizer being connected to a power supply source, and a flexible gas conduit received within said chamber, which has one end thereof projecting outwardly of said chamber through another one of the openings thereof and being connected to the supply system of the plasma-yielding gas, the other end of the conduit communicating with the internal axial space in said plasmatron.

It is expedient that the plasma-arc furnace should comprise another gas conduit including an adaptor flange made of an electrically conductive material, this other gas conduit being fixed in said chamber between said water-cooled rod and said plasmatron and having the inlet thereof connected to said flexible gas conduit and the outlet thereof communicating with the axial through passage or internal space of said plasmatron.

The present invention has enabled the simplification of the technique of manufacturing the rod of the plasmatron-moving mechanism, owing to the fact that the rod no longer includes an axial through passage for the gas supply.

Furthermore, the present invention has provided for a more reliable feed of the plasma-yielding gas via the flexible gas conduit connected to the gas supply system.

Other objects and advantages of the present invention will become apparent from the following description of an embodiment thereof, with reference being had to the accompanying drawing showing a sectional view of a plasma-arc furnace for remelting metals and alloys and the plasma-yielding gas supply system, in accordance with the invention.

In the drawing, the plasma-arc furnace for remelting metals and alloys comprises a chamber 1 with openings made through its wall, which accommodates therein a plasmatron 2 in the form of a consumable electrode with an axial through passage or internal space 3, and a water-cooled rod 4 of a mechanism 5 for moving the plasmatron vertically, which is operatively connected with the plasmatron 2. The rod 4 sealingly extends into the chamber 1 through one of its openings. The furnace includes an arrangement 6 for operatively connecting the plasmatron 2 and the rod 4 and also includes a water-cooled crystallizer 7 communicating with the chamber 1. A gas conduit 8 is mounted between the rod 4 and the plasmatron 2 and includes an adaptor flange made of an electrically conductive material. The gas conduit 8 has at the inlet thereof a connection 9 for the attachment of an end of a flexible gas conduit 10. The other end of the flexible gas conduit 10 projects outwardly of the chamber through another one of its openings, provided especially for this purpose, and communicates via a hose 11 with a source 12 of the plasma-yielding gas. The gas supply source 12 is of any suitable known structure, e.g. that described in the Belgian Pat. No. 789,490.

The rod 4 and the crystallizer 7 are connected via conductors 13 to a power supply source 16, e.g. a D.C. source. The chamber is provided with a valve 14 to exhaust the gas from the chamber into the atmosphere.

The herein disclosed plasma-arc furnace operates, as follows.

The plasmatron 2 (FIG. 1) and the gas conduit 8 are mounted within the chamber 1 on the rod 4, and are positioned coaxially therewith. A protection lining, which is made of a material identical with the material of the plasmatron, is put onto the bottom of the crystallizer 7 (during the initial period of the melting cycle, when there is no molten bath, the lining itself melts and protects the bottom of the crystallizer from the direct action of the plasma). The crystallizer 7 is connected to the chamber to form the furnace, whereafter the furnace is sealed away and evacuated and then the chamber 1 is filled with the plasma-yielding gas. The chamber 1 is filled with the gas from the source 12 through the hose 11, flexible conduit 10, gas conduit 8 and the internal passage 3 of the plasmatron 2.

Upon the chamber 1 having been filled with the gas to a preselected internal pressure, the required gas flow rate through the passage 3 of the plasmatron 2 is established.

With the power supply source 16 being turned on, and electric arc discharge is set between the lower end face of the plasmatron 2 and the protection lining placed on the bottom of the crystallizer 7.

The plasma-yielding gas permanently supplied from the source 12 into the column of the electric arc is ionized by the heat created by the arc, whereby a plasma discharge is ignited in the space below the bottom end face of the plasmatron 2, issuing as a torch from the passage 3 of the electrode. The heat developed adjacent to the electrode and in the plasma discharge column melts the bottom end of the plasmatron 2.

The molten liquid metal falls in droplets into the crystallizer 7 and accumulates there, forming a molten metal bath. As the crystallizer 7 becomes filled with this molten metal bath, the level of the metal therein rises, and the ignition zone of the arc plasma moves upwardly. When the filling factor of the crystallizer 7, which is the ratio of the cross-sectional area of the plasmatron 2 to the cross-sectional area of the crystallizer 7, is below 1:1, the plasmatron 2, as it melts away, is displaced vertically toward the crystallizer 7 jointly with the gas conduit 8, by means of the rod 4 of the mechanism 5.

At the end of the melting cycle, with the plasmatron 2 completely remelted, the plasma-yielding gas supply is cut off, and the power supply source 16 is deenergized. In the course of the remelting process, as the plasma-yielding gas is being supplied into the chamber 1, the excessive gas is exhausted from this chamber into the atmosphere via the valve 14.

By the end of the remelting cycle the chamber 1 is unsealed, and an ingot 15 is removed from the crystallizer 7.

The herein disclosed structure of the plasma-arc furnace is simpler than the hitherto known one, and its manufacture is less costly.

Furthermore, to perform plasma-arc remelting, there is no need, according to the present invention, to manufacture new costly equipment, since the existing vacuum-arc furnaces can be used for the purpose, by simply additionally fitting these existing furnaces with a plasma-yielding gas supply system, a flexible gas conduit, a plasmatron shaped as a hollow consumable electrode and a gas conduit positioned between the rod and the plasmatron.

What is claimed is:

1. A plasma-arc furnace for remelting metals and alloys comprising:
   - a chamber with openings;
   - a plasmatron in the form of a consumable electrode of the metal or alloy to be remelted accommodated within said chamber,
   - said plasmatron having an axial through-going internal space;
   - a mechanism for moving said plasmatron in a substantially vertical direction;
   - a water-cooled rod of said plasmatron-moving mechanism extending into said chamber through one of the openings thereof and being operatively connected with said plasmatron;
   - a water-cooled crystallizer adapted to accumulate therein a liquid metal communicating with said chamber, there being settable a plasma-arc discharge in said crystallizer capable of melting away said plasmatron;
   - a system for supplying a plasma-yielding gas to said chamber;
   - a flexible conduit accommodated within said chamber and having one end thereof projecting outwardly of said chamber through one of the openings thereof and communicating with said plasma-yielding gas supply system, the other end of said flexible conduit being connected to said axial through-going internal space of said plasmatron;
   - and a power supply source to which said water-cooled rod and said crystallizer are connectable.

2. A plasma-arc furnace, as set forth in claim 1, comprising another gas conduit, which includes a flange made of an electrically conductive material, secured between said water-cooled rod and said plasmatron and having an inlet and an outlet, said inlet of said another gas conduit being connected to said flexible conduit and the outlet of said another gas conduit communicating with said through-going axial internal space of said plasmatron.

* * * * *